US009023567B2

(12) United States Patent
Bayley et al.

(10) Patent No.: US 9,023,567 B2
(45) Date of Patent: May 5, 2015

(54) POLYMERIZED CHARGE ENHANCED SPACER PARTICLE

(71) Applicant: Xerox Corporation, Norwalk, CT (US)

(72) Inventors: Robert D. Bayley, Fairport, NY (US); Maura A. Sweeney, Irondequoit, NY (US); Grazyna E. Kmiecik-Lawrynowicz, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 43 days.

(21) Appl. No.: 13/667,448

(22) Filed: Nov. 2, 2012

(65) Prior Publication Data

US 2014/0127620 A1 May 8, 2014

(51) Int. Cl.

| | |
|---|---|
| ***G03G 9/093*** | (2006.01) |
| ***G03G 9/097*** | (2006.01) |
| ***G03G 9/08*** | (2006.01) |

(52) U.S. Cl.

CPC ..... *G03G 9/09783* (2013.01); *G03G 9/0975* (2013.01); *G03G 9/09733* (2013.01); *G03G 9/093* (2013.01); *G03G 9/0804* (2013.01); *G03G 9/09321* (2013.01); *G03G 9/09392* (2013.01); *G03G 9/09741* (2013.01)

(58) Field of Classification Search

CPC ... G03G 9/0804; G03G 9/0815; G03G 9/093; G03G 9/09392; G03G 9/09733; G03G 9/09741; G03G 9/0975

USPC ..... 430/108.1, 108.4, 108.24, 110.2

See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,678 | A | 11/1981 | McKeever |
| 4,338,390 | A | 7/1982 | Lu |
| 4,935,326 | A | 6/1990 | Creatura et al. |
| 4,937,166 | A | 6/1990 | Creatura et al. |
| 5,227,460 | A | 7/1993 | Mahabadi et al. |
| 5,236,629 | A | 8/1993 | Mahabadi et al. |
| 5,330,874 | A | 7/1994 | Mahabadi et al. |
| 6,214,507 | B1 | 4/2001 | Sokol et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,141,761 | B1 | 11/2006 | Dirubio et al. |
| 7,276,320 | B2 | 10/2007 | Kmiecik-Lawrynowicz et al. |
| 2010/0261113 | A1* | 10/2010 | Aruga et al. ..... 430/105 |
| 2011/0086306 | A1* | 4/2011 | Bayley et al. ..... 430/108.2 |

OTHER PUBLICATIONS

Co-pending U.S. Appl. No. 13/416,674, filed Mar. 9, 2012, Sweeney et al.

* cited by examiner

*Primary Examiner* — Peter Vajda

(74) *Attorney, Agent, or Firm* — Pillsbury Winthrop Shaw Pittman LLP

(57) ABSTRACT

A toner particle has a core and a shell surrounding the core, wherein the shell contains a polymerized charge enhanced spacer particle, which is a copolymer of a charge control agent and a monomer. A method of making toner particles includes forming a slurry by mixing together a first emulsion containing a resin, optionally a wax, optionally a colorant, optionally a surfactant, optionally a coagulant, and one or more additional optional additive, heating the slurry to form aggregated particles in the slurry, forming a second emulsion containing a monomer and a charge control agent, polymerizing the second emulsion to form a copolymer of the monomer and the charge control agent, and incorporating the copolymer into the toner particles, wherein the aggregated particles form a core of the toner particles.

19 Claims, No Drawings

POLYMERIZED CHARGE ENHANCED SPACER PARTICLE

BACKGROUND

This disclosure is generally directed to toner processes, and more specifically, emulsion aggregation and coalescence processes, as well as toner compositions formed by such processes, and development processes using such toners.

In a number of electrophotographic engines and processes, toner images are applied to substrates. The toners may then be fused to the substrate by heating the toner with a contact fuser or a non-contact fuser, wherein the transferred heat melts the toner mixture onto the substrate. However, the quality of the developed image may vary depending upon, amongst others, the toner composition properties, the age of the toner (measured in how many print cycles have been completed using the toner composition), and how the toner composition reacts to changes in the operating conditions, such as temperature and relative humidity.

Many current toner formulations show charging that is temperature and humidity specific. For example, many toner formulations perform moderately in ambient (70° F., 20% RH) and low temperature, low humidity (60° F., 10% RH) conditions, but their performance worsens in high temperature, high humidity (80° F., 80% RH) conditions. Satisfactory performance over a broader range of conditions is desired, because the toner composition can be subjected to a range of different operating conditions, while high print quality is still demanded.

Proposed solutions to this problem have been to incorporate a charge control agent (CCA) in the toner composition, either by adding a charge control agent as an external additive to the toner particle surface, where the charge control agent is blended on top of the toner particles, or adding the charge control agent directly into the toner particles as an internal additive. However, incorporation into the toner did not enhance the charge sufficiently, and addition as an external additive did not result in consistent charging properties over time as the toner composition ages. Neither approach has provided an effective solution of providing consistent toner particle charging over time.

This problem is in turn aggravated by the increasing demands placed on the toner development process. For example, electrophotographic engines and processes are being implemented that demand higher print counts, where the toner composition has an increased lifetime in terms of the number of imaging cycles. However, for many toner compositions, the demand of higher print counts has resulted in the problem that additive impaction into the surface of the toner particles increases, detracting from the objective of longer print life. As toner ages past 10,000, 20,000, and even 30,000 prints, the additives become impacted in the toner surface to the extent that charges are reduced and print failure increases.

Thus, a need exists for toner compositions that provide more consistent charging properties over the lifetime of the toner. A need also exists for toner compositions in which the additives do not become so impacted into the toner particle surface before the end of life of the cartridge, thereby allowing for better print performance and consistency in a broader range of temperature/humidity zones and for improved cartridge life.

SUMMARY

The present disclosure provides a toner particle comprising a core and a shell surrounding the core, the shell comprising a polymerized charge enhanced spacer particle comprising a copolymer of a charge control agent and a monomer.

The present disclosure also provides a method of making toner particles, the method comprising:

forming a slurry by mixing together a first emulsion containing a resin, optionally a wax, optionally a colorant, optionally a surfactant, optionally a coagulant, and one or more additional optional additives;

heating the slurry to form aggregated particles in the slurry;

forming a second emulsion comprising:

a monomer; and a charge control agent;

polymerizing the second emulsion to form a copolymer of the monomer and the charge control agent; and incorporating the copolymer into the toner particles, wherein the aggregated particles form a core of the toner particles.

The present disclosure further provides a toner comprising toner particles comprising a core and a shell surrounding the core, the shell comprising a polymerized charge enhanced spacer particle comprising a copolymer of a charge control agent and a monomer.

EMBODIMENTS

The present disclosure provides a toner particle comprising a core and a shell, wherein the shell comprises a polymerized charge enhanced spacer particle. The polymerized charge enhanced spacer particle contains a copolymer of a charge control agent (CCA) and a monomer. Thus, the CCA is incorporated into and is a part of the shell of the toner particles. This results in a number advantages over toner compositions where the CCA is incorporated into the core of the toner particles, and over toner compositions where the CCA is added as an external additive to the toner particles.

For example, incorporating the CCA into the shell spacer particles by copolymerization decreases the interaction of charge control agents with carboxylic acid groups in emulsion aggregation and coalescence processes, which decreases loss of the CCA from the toner particles. This, in turn, further enhances negative charging of the toner, resulting in toners with excellent charging characteristics, and extends the life of the toner. Because incorporating the CCA into the shell spacer particles reduces the amount of conventional surface additives required to adjust the triboelectric charge, this incorporation may also result in a cost savings.

When using the term "about," also include the following paragraph in the specification: "As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

Latex Polymer

Any monomer suitable for preparing a latex for use in a toner may be used in preparing the toner. Suitable monomers include styrenes, acrylates, methacrylates, butadienes, isoprenes, acrylic acids, methacrylic acids, acrylonitriles, combinations thereof, and the like.

The latex polymer may include a single polymer or a mixture of polymers. Suitable polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

Polyester resins may also be used to form a latex polymer. The polyester resin may be included in addition to the latex polymers described above, or may be substituted for the latex polymer.

Any polyester resin may be used in making polyester latexes. The resin may be an amorphous resin, a crystalline resin, and/or a combination thereof. The resin may be a polyester resin, such as described in U.S. Pat. Nos. 6,593,049 and 6,756,176, the disclosures of each of which are hereby incorporated by reference in their entirety. Suitable resins also include a mixture of an amorphous polyester resin and a crystalline polyester resin as described in U.S. Pat. No. 6,830,860, the disclosure of which is hereby incorporated by reference in its entirety.

The polyester resin may be obtained from the reaction products of bisphenol A and propylene oxide or propylene carbonate, as well as the polyesters obtained by reacting those reaction products with fumaric acid, for example, as disclosed in U.S. Pat. No. 5,227,460, the entire disclosure of which is incorporated herein by reference, and branched polyester resins resulting from the reaction of dimethylterephthalate with 1,3-butanediol, 1,2-propanediol, and pentaerythritol.

If the polymer is not formed as an emulsion, the emulsion aggregation (EA) process requires polymers to be first formulated into latex emulsions, for example, by solvent containing batch processes, such as solvent flash emulsification and/or solvent-based phase inversion emulsification.

The crosslinked resin may be a crosslinked polymer, such as crosslinked styrene acrylates, styrene butadienes, and/or styrene methacrylates. Suitable crosslinked resins include crosslinked poly(styrene-alkyl acrylate), poly(styrene-butadiene), poly(styrene-isoprene), poly(styrene-alkyl methacrylate), poly(styrene-alkyl acrylate-acrylic acid), poly(styrene-butadiene-acrylic acid), poly(styrene-isoprene-acrylic acid), poly(styrenealkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile acrylic acid), crosslinked poly(alkyl acrylate-acrylonitrile-acrylic acid), and mixtures thereof.

A crosslinker, such as divinyl benzene or other divinyl aromatic or divinyl acrylate or methacrylate monomers, may be used in crosslinking the polymer. The crosslinker may be present in an amount of from about 0.01 to about 25 wt % of the crosslinked resin, such as from about 0.5 to about 15 wt %, or from about 1 to about 10 wt %.

The crosslinked resin particles may be present in the toner in an amount of from about 1 to about 20 wt % of the toner, such as from about 4 to about 15 wt %, or from about 5 to about 14 wt %.

The resin utilized to form the toner may be a mixture of a gel resin and a non-crosslinked resin. A gel latex may be added to the non-crosslinked latex resin suspended in the surfactant. A gel latex refers to, for example, a latex containing crosslinked resin or polymer, or mixtures thereof, or a non-crosslinked resin that has been subjected to crosslinking.

The gel latex may include submicron crosslinked resin particles having a size of from about 10 to about 200 nm in volume average diameter, such as from about 20 to about 100 nm, or from about 30 to about 80 nm. The gel latex may be suspended in an aqueous phase of water containing a surfactant, wherein the surfactant may be in an amount from about 0.5 to about 5 wt % of the total solids, such as from about 0.7 to about 2 wt %, or from about 0.75 to 1.5 wt %

Surfactants

Colorants, waxes, and other additives used to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be used. Suitable surfactants include ionic or nonionic surfactants. Anionic surfactants and cationic surfactants are encompassed by the term "ionic surfactants." The surfactant may be used so that it is present in an amount of from about 0.01 to about 15 wt % of the toner composition, for example from about 0.75 to about 4 wt % of the toner composition, or from about 1 to about 3 wt % of the toner composition.

Suitable nonionic surfactants include, for example, alcohols, acids and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F or SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of suitable cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, cetyl pyridinium bromide halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

The choice of particular surfactants or combinations thereof, as well as the amounts of each to be used, are within the purview of those skilled in the art.

Initiators

Initiators may be added for formation of the latex polymer. Suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Additional water-soluble initiators include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methylpropionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)-2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators may be added in any suitable amount, such as, from about 0.1 to about 8 wt % of the monomers, from about 0.2 to about 5 wt %, or from about 0.3 to 4 wt %.

Chain Transfer Agents

Chain transfer agents may also be used in forming the latex polymer. Suitable chain transfer agents include dodecane thiol, octane thiol, carbon tetrabromide, and the like, or combinations thereof. The charge transfer agents may be added in any suitable amount, for example from about 0.1 to about 10 wt % of the monomers, from about 0.2 to about 5 wt %, or from about 0.3 to about 4 wt %. The charge transfer agents control the molecular weight properties of the latex polymer when emulsion polymerization is conducted.

Colorants

Various known suitable colorants, such as dyes, pigments, mixtures of dyes, mixtures of pigments, mixtures of dyes and pigments, and the like, may be included in the toner. The colorant may be included in the toner in an amount of, for example, from about 0.1 to about 35 wt % of the toner, from about 1 to about 15 wt % of the toner, or from about 3 to about 10 wt % of the toner.

Examples of suitable colorants include carbon black like REGAL 330®; magnetites, such as Mobay magnetites MO8029™ and M08060™; Columbian magnetites; MAPICO BLACKS™; and surface treated magnetites; Pfizer magnetites CB4799™, CB5300™, CB5600™, and MCX6369™; Bayer magnetites, BAYFERROX 8600™ and 8610™; Northern Pigments magnetites NP-604™ and NP-608™; Magnox magnetites TMB-100™ and TMB-104™; and the like. Suitable colored pigments include cyan, magenta, yellow, red, green, brown, blue, or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

The toners may optionally contain a wax, which can be either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Optionally, a wax may also be combined with the resins in forming toner particles. When included, the wax may be present in an amount of, for example, from about 1 to about 25 wt % of the toner particles, from about 2 to about 25 wt %, or from about 5 to about 20 wt % of the toner particles.

Waxes that may be selected include waxes having, for example, a weight average molecular weight of from about 500 to about 20,000, such as from about 700 to about 15,000, or from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™ and SUPERSLIP 6530™ available from Micro Powder Inc., fluorinated waxes, for example POLYFLUO 190™, POLYFLUO 200™, POLYSILK 19™, and POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used. Waxes may be included as, for example, fuser roll release agents.

Toner Preparation

The toner particles may be prepared by any method within the purview of one skilled in the art. For example, toners may be prepared by combining a latex polymer binder, an optional wax, an optional colorant, and other optional additives. Although emulsion-aggregation processes are described below, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. Toner compositions and toner particles may be prepared by aggregation and coalescence processes in which small-size resin particles are aggregated to the appropriate toner particle size and then coalesced to achieve the final toner-particle shape and morphology.

Toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resins.

In the emulsion polymerization process, the reactants may be added to a suitable reactor, such as a mixing vessel. The appropriate amount of at least one monomer, for example, from one to about ten monomers, surfactant(s), optional functional monomer, optional initiator, optional chain transfer agent, and the like, may be combined in the reactor and the emulsion polymerization process may be initiated. Reaction conditions selected for effecting the emulsion polymerization include temperatures of, for example, from about 45° C. to about 120° C., such as from about 60° C. to about 90° C., or from about 65° C. to about 85° C.

Polymerization may be continued until the desired size particles are formed. For example, the particles may be from about 40 to about 800 nm in volume average diameter, such as from about 100 to about 400 nm, or from about 140 to about 350 nm, as determined, for example, by a Microtrac UPA150 particle size analyzer.

The pH of the resulting mixture may be adjusted by an acid such as, for example, acetic acid, nitric acid, sulfuric acid, hydrochloric acid, citric acid, or the like and optionally combinations thereof. The pH of the mixture may be adjusted to from about 2 to about 8, such as from about 2.5 to about 5.5, or from about 2.5 to about 4.5. The mixture may be homogenized. If the mixture is homogenized, homogenization may be accomplished by mixing at about 600 to about 8000 revolutions per minute (rpm), for example, from at about 2000 to about 7000 rpm, or at about 4000 to about 6000 rpm. Homogenization may be accomplished by any suitable means, including, for example, an IKA ULTRA TURRAX T50 probe homogenizer.

Following the preparation of the above mixture, an aggregating agent may be added to the mixture. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. The aggregating agent, for example, a polymetal salt, may be in a solution of nitric acid, or other diluted acid solutions, such as sulfuric acid, hydrochloric acid, citric acid, or acetic acid. The aggregating agent may be added to the mixture at a temperature that is below the glass transition temperature (Tg) of the resin.

The aggregating agent may be added to the mixture used to form a toner in an amount of, for example, from about 0.1 to about 0.25 parts per hundred (pph), from about 0.11 to about 0.20 pph, or from about 0.12 to about 0.18 pph, of the resin in the mixture. This provides a sufficient amount of agent for aggregation.

The gloss of a toner may be influenced by the amount of retained metal ion, such as $Al^{3+}$, in the particle. The amount of retained metal ion may be further adjusted by the addition of materials such as EDTA. The amount of retained crosslinker, for example $Al^{3+}$, in toner particles may be from about 0.1 to about 1 pph, from about 0.25 to about 0.8 pph, or about 0.5 pph.

In order to control aggregation and coalescence of the particles, the aggregating agent may be metered into the mixture over time. For example, the agent may be metered into the mixture over a period of from about 5 to about 240 minutes, from about 30 to about 200 minutes, or from about 40 to about 120 minutes. The addition of the agent may also be done while the mixture is maintained under stirred conditions, for example from about 50 to about 1,000 rpm, from about 100 to about 500 rpm, or from about 125 to about 450 rpm, and at a temperature that is below the glass transition temperature of the resin as discussed above, for example from about 30° C. to about 90° C., from about 35° C. to about 70° C., or from about 40° C. to about 65° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., from about 45° C. to about 75° C., or from about 50° C. to about 65° C., and holding the mixture at this temperature for a time from about 30 to about 360 minutes, from about 50 to about 300 minutes, or from about 60 to about 120 minutes, while maintaining stirring, to provide the aggregated particles. Once the predetermined desired particle size is reached, then the growth process is halted. The predetermined desired particle size may be within the toner particle size ranges mentioned above.

Shell Formation

While not required, a shell may be applied to the formed aggregated toner particles. Any resin described above as suitable for the core resin may be used as the shell resin. In some embodiments, the shell resin comprises or consists of one or more amorphous resins. The shell resin may be applied to the aggregated particles by any method within the purview of those skilled in the art. The shell resin may be in an emulsion including any surfactant described above. The aggregated particles described above may be combined with the emulsion so that the resin forms a shell over the formed aggregates. The shell latex may also be applied by, for example, dipping, spraying, and the like. The shell latex may be applied until the desired final size of the toner particles is achieved. For example, the final size of the toner particles may be from about 2 to about 15 microns, such as from about 3 to about 10 microns, or from about 3.5 to about 8 microns.

An amorphous polyester may be used to form a shell over the aggregates to form toner particles having a core-shell configuration. Alternatively, a styrene-n-butyl acrylate copolymer may be used to form the shell latex. The latex used to form the shell may have a glass transition temperature of from about 35° C. to about 75° C., such as from about 40° C. to about 70° C., or from about 45° C. to about 65° C. The shell may include a second non-crosslinked polymer, such as a styrene, an acrylate, a methacrylate, a butadiene, an isoprene, an acrylic acids, a methacrylic acid, an acrylonitrile, a polyester, and the like, or combinations thereof.

When a shell is applied to the formed aggregated toner particles, the shell latex may be added in an amount of from about 20 to about 40 wt % of the dry toner particle, such as from about 26 to about 36 wt %, or from about 28 to about 34 wt %.

The resin emulsion used in the shell-formation process generally includes particles having a size of from about 100 about 260 nm, from about 105 to about 155 nm, or about 110 nm, and generally has a solids loading of from about 10 to about 50 wt % solids, about 15 to about 40 wt % solids, or about 35 wt % solids. Of course, other emulsions can also be used.

Polymerized Charge Enhanced Spacer Particles

The toner particles may contain polymerized charge enhanced spacer particles, which comprise a copolymer of a charge control agent and a monomer.

Suitable charge control agents include metal complexes of alkyl derivatives of acids such as salicylic acid, other acids such as dicarboxylic acid derivatives, benzoic acid, oxynaphthoic acid, sulfonic acids, other complexes such as polyhydroxyalkanoate quaternary phosphonium trihalozincate, metal complexes of dimethyl sulfoxide, combinations thereof, and the like. Metals used in forming such complexes include zinc, manganese, iron, calcium, zirconium, aluminum, chromium, combinations thereof, and the like. Alkyl groups that may be used in forming derivatives of salicylic acid include methyl, butyl, t-butyl, propyl, hexyl, combinations thereof, and the like. Examples of such charge control agents include those commercially available as BONTRON® E-84 and BONTRON® E-88 (commercially available from Orient Chemical). BONTRON® E-84 is a zinc complex of 3,5-di-tert-butylsalicylic acid in powder form. BONTRON® E-88 is a mixture of hydroxyaluminium-bis[2-hydroxy-3,5-di-tert-butylbenzoate] and 3,5-di-tert-butylsalicylic acid. Other charge control agents suitable for copolymerization with monomers are the calcium complex of 3,5-di-tert-butylsalicylic acid, a zirconium complex of 3,5-di-tert-butylsalicylic acid, and an aluminum complex of 3,5-di-tert-butylsalicylic acid, as disclosed in U.S. Pat. Nos. 5,223,368 and 5,324,613, the disclosures of each of which are incorporated by reference in their entirety, combinations thereof, and the like.

Suitable monomers include functional monomers having carboxylic acid functionality, such as acrylic acid, methacrylic acid, β-CEA, poly(2-carboxyethyl)acrylate, 2-carboxyethyl methacrylate, acrylic acid and its derivatives, combinations thereof, and the like. For example, functional monomers may be of the following formula (I):

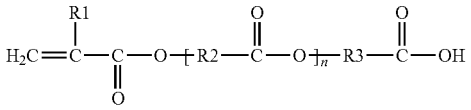

(I)

where R1 is hydrogen or a methyl group; R2 and R3 are independently selected from alkyl groups containing from about 1 to about 12 carbon atoms or a phenyl group; n is from about 0 to about 20, such as from about 1 to about 10, or from about 2 to about 8. Suitable functional monomers include beta carboxyethyl acrylate (β-CEA), poly(2-carboxyethyl)acrylate, 2-carboxyethyl methacrylate, combinations thereof, and the like.

Functional monomers having carboxylic acid functionality may also contain a small amount of metallic ions, such as sodium, potassium, and/or calcium, to achieve better emulsion polymerization results. The metallic ions may be present in an amount from about 0.001 to about 10 wt %, for example from about 0.5 to about 5 wt %, or from about 1.0 to about 3.5 wt % of the functional monomer having carboxylic acid functionality.

The functional monomer may be added in amounts from about 0.01 to about 5 wt % of the toner, such as from about 0.05 to about 2 wt %, or from about 0.1 to about 1 wt %.

The polymerized enhanced charge spacer particles may comprise one or more CCAs and one or more monomers. For example, the CCA may be a zinc-type salicylic acid or an aluminum-type salicylic acid, and the monomer may be methyl methacrylate.

The monomer may be present in an amount of from about 99.9 to about 80.0 wt % of the total weight of the polymerized enhanced charge spacer particles, for example, from about 99.6 to about 85.0 wt %, or from about 99.0 to about 92.0 wt %. The CCA may be present in an amount of from about 0.01 to about 20.0 wt % of the total weight of the polymerized enhanced charged spacer particles, for example, from about 0.1 to about 15.0 wt %, or from about 0.5 to about 8.0 wt %.

Conditions for forming the polymerized charge enhanced spacer particles are within the purview of those skilled in the art. The polymerized charge enhanced spacer particles may be formed by combining and dissolving the charge control agent ("CCA"), functional monomer, additional monomer, chain transfer agent, and optional surfactant in a suitable container, such as a mixing vessel. The appropriate amount of seed monomers, functional monomers, and the like may then be combined in a reactor, which contains an appropriate amount of water and surfactant, followed by addition of an appropriate amount of initiator to commence the process of latex seed formation. Once the seed particles have been formed, the feed monomers mixture containing the dissolved CCA is commenced to grow the polymerized charge enhanced spacer particles to the desired particle size.

The mixture may be polymerized by, for example, emulsion polymerization, suspension polymerization, dispersion polymerization, and combinations thereof.

Reaction conditions selected for forming the polymerized charge enhanced spacer particles include temperatures of, for example, from about 30° C. to about 90° C., such as from about 40° C. to about 75° C., or from about 45° C. to about 70° C. Mixing may occur at a rate of from about 75 to about 450 revolutions per minute (rpm), such as from about 120 to about 300 rpm, or from about 150 to about 250 rpm. The reaction may continue until the polymerized charge enhanced spacer particles have formed, which may take from about 100 to about 660 minutes, such as from about 200 to about 400 minutes, or until monomer conversion is complete to obtain low acceptable residual volatiles.

Any surfactant described above may be used in forming the polymerized charge enhanced spacer particles. Where used, a surfactant may be present in an amount of from about 0.25 to about 1.25 wt % of the polymerization mixture, for example, from about 0.37 to about 0.85 wt %, or from about 0.45 to about 0.7 wt %.

Reaction conditions selected for forming the polymerized charge enhanced spacer particle include temperatures of, for example, from about 30° C. to about 100° C., from about 40° C. to about 90° C., or from about 45° C. to about 80° C. Mixing may occur at a rate of, for example, from about 75 to about 450 revolutions per minute (rpm), from about 100 to about 450 rpm, or from about 120 to about 300 rpm. The reaction may continue until the polymerized charge enhanced spacer particle has formed, which may take from about 100 to about 660 minutes, for example, from about 200 to about 400 minutes, for example from 225 to about 300 minutes, or until monomer conversion is complete to obtain low acceptable residual volatiles.

The resulting polymerized charge enhanced spacer particles may have a particle size of from about 250 to about 1000 nm, such as from about 300 to about 650 nm, or about 325 to about 500 nm. Additionally, the polymerized charge enhanced spacer particles thus produced are negatively charged.

The polymerized charge enhanced spacer particles may be incorporated into the toner particle shell by addition of the polymerized charge enhanced spacer particles to the shell latex prior to adding the shell latex to the core, addition of the polymerized charge enhanced spacer particles to the last 10, 20, or 30% of the residual shell latex during shell latex formation, addition of the polymerized charge enhanced spacer particles at end of the shell latex formation, or blending the polymerized charge enhanced spacer particles on to the surface of a dry particle.

For example, during the shell formation process, at any desired point, the polymerized charge enhanced spacer particles can be incorporated onto/into the shell, with completion of the shell formation. This incorporation can be conducted by adding the polymerized charge enhanced spacer particles into the shell-forming emulsion, where the polymerized charge enhanced spacer particles can be added directly into the emulsion, or desirably a solution or emulsion containing the polymerized charge enhanced spacer particles is added to the shell-forming emulsion. Incorporation of spacer particles onto/into toner particles is described, for example, in U.S. Pat. No. 7,276,320, the disclosure of which is hereby incorporated by reference in its entirety.

Additives

The toner particles may also contain other optional additives, as desired or required. For example, the toner may include positive or negative charge control agents, separate from the polymerized charge enhanced spacer particle described above, for example in an amount of from about 0.1 to about 10 wt %, from about 1 to about 3 wt %, or from 1.5 to about 2.5 wt % of the toner. Suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof; and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 to about 5 wt % of the toner, from about 0.25 to about 3 wt % of the toner, or about 1.5 to about 2.5 wt %, although amounts outside these ranges can be used. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

Toner Particle Properties

The properties of the toner particles may be determined by any suitable technique and apparatus. Volume average particle diameter ($D_{50v}$), volume average geometric standard deviation (GSDv), and number average geometric standard deviation (GSDn) may be measured by means of a measuring instrument such as a Beckman Coulter Multisizer 3, operated in accordance with the manufacturer's instructions. Representative sampling may occur as follows: a small amount of dry toner sample, about 200 mg, such as about 300 mg, or about 400 mg, may be put in isotonic solution with the sample then run in a Beckman Coulter Multisizer 3.

The toner particles produced may possess excellent charging characteristics when exposed to extreme relative humidity (RH) conditions. The low-humidity zone (C zone) may be about 10° C., 15% RH, for example about −50 μC/g, or about −100 μC/g, while the high humidity zone (A zone) may be about 28° C., 85% RH, for example about −15 μC/g, or about −40 μC/g. In the low-humidity zone, the toner particles may accept a charge of about −45 μC/g, such as, about −65 μC/g, or about −85 μC/g, and in the high-humidity zone, the toner particles may accept a charge of about −15 μC/g, such as, about −25 μC/g, or about −45 μC/g.

Toners may also possess a parent toner charge per mass ratio (Q/M) of from about −3 to about −45 μC/g, from about −10 to about −40 μC/g, or from about −15 to about −35 μC/g, and a final toner charging after surface additive blending of from −10 to about −85 μC/g, for example from about −15 to about −65 μC/g, or from about −20 to about −55 μC/g.

The toner particles may possess a parent toner charge per mass ratio (Q/M) of above about −35 μC/g in A-zone (80° F., 80-85% RH), such as about −35 to about −80 μC/g, or about −40 to about −70 μC/g; above about −65 μC/g in B-zone (70° F., 50% RH), such as about −65 to about −100 μC/g, or about −45 to about −85 μC/g; and above about −80 μC/g in J-zone (70° F., 10% RH), such as about −80 to about −120 μC/gm, or about −75 to about −90 μC/g.

Using the methods of the present disclosure, desirable gloss levels may be obtained. Thus, for example, the gloss level of the toner may have a gloss as measured by Gardner Gloss Units (ggu) of from about 10 to about 100 ggu, from about 50 to about 95 ggu, or from about 15 to about 65 ggu.

The dry toner particles, exclusive of external surface additives, may have the following characteristics:

(1) Volume average diameter (also referred to as "volume average particle diameter") of from about 2.5 to about 20 microns, from about 2.75 to about 10 microns, or from about 3 to about 9 microns.

(2) Number Average Geometric Standard Deviation (GSDn) and/or Volume Average Geometric Standard Deviation (GSDv) of from about 1.05 to about 1.55, from about 1.1 to about 1.4, or from about 1.16 to about 1.26.

(3) Circularity of from about 0.9 to about 1 (measured with, for example, a Sysmex FPIA 2100 analyzer), from about 0.93 to about 0.99, or from about 0.95 to about 0.98.

(4) Glass transition temperature of from about 45° C. to about 65° C., for example from about 48° C. to about 62° C., or from about 49° C. to about 60° C.

(5) The toner particles can have a surface area, as measured by the well-known BET method, of about 0.5 to about 6.5 $m^2/g$, such as about 0.8 to about 1.8 $m^2/g$, or about 0.9 to about 1.5 $m^2/g$. For example, for cyan, yellow, magenta, and black toner particles, the BET surface area can be less than 1 $m^2/g$, such as from about 0.8 to about 1.8 $m^2/g$, such as about 0.85 to about 1.6 $m^2/g$, or about 0.9 to about 1.2 $m^2/g$.

It may be desirable that the toner particle possess separate crystalline polyester and wax melting points and amorphous polyester glass transition temperature as measured by DSC, and that the melting temperatures and glass transition temperature are not substantially depressed by plasticization of the amorphous or crystalline polyesters, or by any optional wax. To achieve non-plasticization, it may be desirable to carry out the emulsion aggregation at a coalescence temperature of less than the melting point of the crystalline component and wax components.

Developers

The toner particles may be used directly as a single component developer, i.e., without a separate carrier. The toner particles thus formed may be formulated into a developer composition. The toner particles may be mixed with carrier particles to achieve a two-component developer composition. The toner concentration in the developer may be from about 1 to about 25 wt % of the total weight of the developer, from about 2 to about 15 wt % of the total weight of the developer, or from about 3 to about 9 wt % of the total weight of the developer.

Examples of carrier particles that can be used for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

Polymethylmethacrylates (PMMA) may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 wt %, from about 0.01 to about 3 wt %, or from about 0.5 to about 2.5 wt % based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

Suitable carriers may include a steel core, for example of from about 25 to about 100 μm in size, from about 50 to about 75 μm, or from about 30 to about 60 μm coated with about 0.5 to about 10 wt %, from about 0.7 to about 5 wt %, or from about 0.8 to about 2.5 wt % of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations may be from about 1 to about 20 wt % of the toner composition, for example from about 2 to about 15 wt %, or from about 4 to about 10 wt %. However, different toner and carrier percentages may be used to achieve a developer composition with desired characteristics.

Imaging

The toners can be used for electrophotographic processes, including those disclosed in U.S. Pat. No. 4,295,990, the disclosure of which is hereby incorporated by reference in its entirety. Any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. The development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium, such as paper and the like. The toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. The fuser member may be heated to a temperature above the fusing temperature of the toner, for example to temperatures of from about 70° C. to about 160° C., from about 80° C. to about 150° C., or from about 90° C. to about 140° C., after or during melting onto the image receiving substrate.

The fusing of the toner image may be conducted by any conventional means, such as combined heat and pressure fusing such as by the use of heated pressure rollers. Irradiation may also be used, for example, in the same fusing housing and/or step where conventional fusing is conducted, or it can be conducted in a separate irradiation fusing mechanism and/or step. This irradiation step may provide non-contact fusing of the toner, so that conventional pressure fusing may not be required.

For example, the irradiation may be conducted in the same fusing housing and/or step where conventional fusing is conducted. The irradiation fusing may be conducted substantially simultaneously with conventional fusing, such as be locating an irradiation source immediately before or immediately after a heated pressure roll assembly. Desirably, such irradiation is located immediately after the heated pressure roll assembly, such that crosslinking occurs in the already fused image.

The irradiation may be conducted in a separate fusing housing and/or step from a conventional fusing housing and/or step. For example, the irradiation fusing can be conducted in a separate housing from the conventional such as heated pressure roll fusing. That is, the conventionally fused image can be transported to another development device, or another component within the same development device, to conduct the irradiation fusing. In this manner, the irradiation fusing can be conducted as an optional step, for example to irradiation cure images that require improved high temperature document offset properties, but not to irradiation cure images that do not require such improved high temperature document offset properties. The conventional fusing step thus provides acceptable fixed image properties for moist applications, while the optional irradiation curing can be conducted for images that may be exposed to more rigorous or higher temperature environments.

The toner image may be fused by irradiation and optional heat, without conventional pressure fusing. This may be referred to as noncontact fusing. The irradiation fusing can be conducted by any suitable irradiation device, and under suitable parameters, to cause the desired degree of crosslinking of the unsaturated polymer. Suitable non-contact fusing methods are within the purview of those skilled in the art and include flash fusing, radiant fusing, and/or steam fusing.

Non-contact fusing may occur by exposing the toner to infrared light at a wavelength of from about 800 to about 1000 $cm^{-1}$, from about 800 to about 950 $cm^{-1}$, or from about 850 to about 900 $cm^{-1}$, for a period of time of from about 5 milliseconds to about 2 seconds, from about 50 milliseconds to about 1 second, or from about 100 milliseconds to about 0.5 second.

Where heat is also applied, the image can be fused by irradiation such as by infrared light, in a heated environment such as from about 100° C. to about 250° C., from about 125° C. to about 225° C., or from about 150° C. or about 160° C. to about 180° C. or about 190° C.

Exemplary apparatuses for producing these images may include a heating device possessing heating elements, an optional contact fuser, a non-contact fuser such as a radiant fuser, an optional substrate pre-heater, an image bearing member pre-heater, and a transfuser. Examples of such apparatus include those disclosed in U.S. Pat. No. 7,141,761, the disclosure of which is hereby incorporated by reference in its entirety.

When the irradiation fusing is applied to the toner composition, the resultant fused image is provided with non-document offset properties, that is, the image does not exhibit document offset, at temperature up to about 90° C., such as up to about 85° C., or up to about 80° C. The resultant fused image also exhibits improved abrasion resistance and scratch resistance as compared to conventional fused toner images. Such improved abrasion and scratch resistance is beneficial, for example, for use in producing book covers, mailers, and other applications where abrasion and scratches would reduce the visual appearance of the item. Improved resistance to solvents is also provided, which is also beneficial for such uses as mailers, and the like. These properties are particularly helpful, for example, for images that must withstand higher temperature environments, such as automobile manuals that typically are exposed to high temperatures in glove compartments or printed packaging materials that must withstand heat sealing treatments.

It is envisioned that the toners of the present disclosure may be used in any suitable procedure for forming an image with a toner, including in applications other than xerographic applications.

EXAMPLES

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

Example 1

Preparation of Latex Incorporating a Charge Control Additive

A monomer mixture of about 1498.0 parts by weight of styrene, obtained from Scientific Polymer Products, and about 358.0 parts by weight of n-butyl acrylate, obtained from Scientific Polymer Products, at a weight ratio of about 81:19, was combined with about 27.0 parts by weight of 1-dodecanethiol, obtained from Sigma-Aldrich, in an amount of about 1.38 wt % based on the total weight of styrene/n-butyl acrylate, and about 74.0 parts by weight of 3,5 di-tert-butylsalicylic acid, zinc salt CCA, obtained from Orient Corporation of America, in an amount of about 4 wt % based upon the total weight of the styrene/n-butyl acrylate. To this mixture, at which point the CCA was not fully soluble, was added about 56.0 parts by weight of β-carboxyethyl acrylate (β-CEA), obtained from Bimax, in an amount of about 3 wt % based on the total weight of styrene/n-butyl acrylate. Upon stirring the monomer mixture for about 20 minutes, the 3,5 di-tert-butylsalicylic acid, zinc salt was fully solubilized and incorporated into the monomer mixture.

A seed monomer mixture was prepared from about 34.0 parts by weight of styrene, about 8.0 parts by weight of n-Butyl acrylate, about 0.6 parts by weight of 1-Dodecanethiol, and about 1.26 parts by weight of β-CEA.

A surfactant feed stock solution was prepared from about 750 parts by weight distilled water and about 48.0 parts by weight of DOWFAX™ 2A1, an alkyldiphenyloxide disulfonate of The Dow Chemical Company.

A latex resin was prepared by emulsion polymerization of the above monomer mixtures as follows.

An 8 liter jacketed glass reactor was fitted with stainless steel 45° pitch semi-axial flow impellers, a thermal couple temperature probe, a water cooled condenser with nitrogen outlet, a nitrogen inlet, internal cooling capabilities, and a hot water circulating bath. After reaching a jacket temperature of about 83° C. and continuous nitrogen purge, the reactor was charged with about 1925 parts by weight of distilled water and about 7.0 parts by weight of DOWFAX™ 2A1, an alkyldiphenyloxide disulfonate from The Dow Chemical Company. The stirrer was set at about 170 revolutions per minute (rpm) and maintained at this speed for about 1 hour with the reactor contents kept at a temperature of about 75° C. using the internal cooling system.

The seed monomer mixture was transferred into the reactor and stirred for about 20 minutes to maintain a stable emulsion and allow the reactor contents to equilibrate at about 75° C. An initiator solution prepared from about 37.0 parts by weight of ammonium persulfate, obtained from FMC, and about 129.0 parts by weight of distilled water was then added over a period of about 20 minutes. Stirring was continued for about an additional 20 minutes to complete seed particle formation. The resulting seed particles had a size of about 48 nm, as measured on a Honeywell MICROTRAC® UPA 150 light scattering instrument.

At this time, the main monomer feed of the monomer mixture containing the dissolved 3,5 Di-tert-butylsalicylic acid, zinc salt, was added at a feed rate of about 7.5 parts by weight per minute, with simultaneous addition of the surfactant feed stock solution at a feed rate of about 3.0 parts by weight per minute.

Monomer and surfactant feed was continued and after 135 minutes, or after about 1013 parts by weight of the above monomer mixture, containing the dissolved 3,5 Di-tert-butylsalicylic acid, zinc salt was added, the latex particle size was about 158 nm, as measured on a Honeywell MICROTRAC® UPA 150 light scattering instrument.

Monomer feed and surfactant solution feed were continued for about 270 minutes until a total of about 2011.0 parts by weight of monomer feed and total of about 798.0 parts of surfactant feed were added, completing the monomer and surfactant addition. The reactor contents were then stirred for about an additional 240 minutes at about 75° C. while under a continuous nitrogen atmosphere, to complete monomer conversion.

At this time the reactor and contents were cooled to room temperature, and the latex was removed and filtered.

The resulting latex particle size had a volume average diameter of about 204 nm, as measured on a Honeywell MICROTRAC® UPA 150 light scattering instrument, showing that particle size can be increased by further addition of monomer.

Comparative Example 1

Preparation of a Comparative Latex Incorporating a Charge Control Additive

A latex was prepared by the same procedure as that in Example 1 but with increased addition of the main monomer feed of the above monomer mixture, containing the dissolved 3,5 Di-tert-butylsalicylic acid, zinc salt, with simultaneous addition of surfactant feed stock to continue the growth of the latex particle.

The total feed time increased past 270 minutes, with appropriate increased surfactant feed, until the desired particle size of 300 to 500 nanometers as measured on a Honeywell MICROTRAC® UPA 150 light scattering instrument was achieved.

Example 3

Preparation of Latex Incorporating a Charge Control Additive with Methyl Methacrylate A latex was prepared by the same procedure as that in Comparative Example 2; however, the styrene/n-butyl acrylate monomer was replaced with methyl methacrylate monomer and addition of the main monomer feed of the above monomer mixture, containing the dissolved 3,5 di-tert-butyl-salicylic acid, zinc salt, was increased with simultaneous addition of surfactant feed stock to continue the growth of the latex particle.

As an example, the total feed time is increased past 270 minutes, with appropriate increased surfactant feed, until the desired particle size of 300 to 500 nm as measured on a Honeywell MICROTRAC® UPA 150 light scattering instrument is achieved.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making toner particles, comprising:

forming a slurry by mixing together a first emulsion containing a resin, optionally a wax, optionally a colorant, optionally a surfactant, optionally a coagulant, and one or more additional optional additives;

heating the slurry to form aggregated particles in the slurry;

forming a second emulsion comprising:

a monomer; and a charge control agent;

polymerizing the second emulsion to form a polymerized charge enhanced spacer particle having a particle size from about 350 nm to about 500 nm; and incorporating the polymerized charge enhanced spacer particle on the surface of the toner particles.

2. The method of claim 1, further comprising forming a shell surrounding the core.

3. The method of claim 2, wherein, prior to forming the shell on the core, the copolymer is added to a latex forming the shell.

4. The method of claim 1, wherein the charge control agent is selected from the group consisting of quarternary ammonium compounds, organic sulfate and sulfonate compounds, cetyl pyridinium tetrafluoroborates, distearyl dimethyl ammonium methyl sulfate, aluminum salts, zinc salts, and triarylamines.

5. The method of claim 1, wherein the monomer is a functional monomer.

6. The method of claim 1, wherein the charge control agent is a zinc-type salicylic acid or an aluminum-type salicylic acid, and the monomer is methyl methacrylate.

7. A toner particle, comprising:

a core;

an optional shell surrounding the core; and charge enhanced spacer particles comprising a copolymer of a charge control agent and a monomer, wherein the charge enhanced spacer particles have a particle size from about 350 nm to about 500 nm, wherein the charge enhanced spacer particles are disposed on the surface of the core or the optional shell.

8. The toner particle of claim 7, wherein the charge control agent is selected from the group consisting of quarternary ammonium compounds, organic sulfate and sulfonate compounds, cetyl pyridinium tetrafluoroborates, distearyl dimethyl ammonium methyl sulfate, aluminum salts, zinc salts, and triarylamines.

9. The toner particle of claim 7, wherein the monomer is a functional monomer.

10. The toner particle of claim 9, wherein the functional monomer possesses carboxylic acid functionality.

11. The toner particle of claim 9, wherein the functional monomer is selected from the group consisting of acrylic acid, methacrylic acid, β-carboxylic acrylate, poly(2-carboxyethyl) acrylate, 2-carboxyethyl methacrylate, and combinations thereof.

12. The toner particle of claim 7, wherein the charge control agent is a zinc-type salicylic acid or an aluminum-type salicylic acid, and the monomer is methyl methacrylate.

13. The toner particle of claim 7, wherein the charge control agent is present in the charge enhanced spacer particle in an amount of from about 0.01 to about 20 wt % of a total weight of the charge enhanced spacer particle, and the monomer is present in the charge enhanced spacer particle in an amount from about 80 to about 99.9 wt % of the total weight of the charge enhanced spacer particle.

14. The toner particle of claim 7, wherein the toner particle possesses a triboelectric charge of from about −10 μC/g to about −40 μC/g.

15. The toner particle of claim 7, wherein the toner particle accepts a particle charge of above about −50 μC/g in an environment of about 10° C. and about 15% relative humidity, and the toner particle accepts a particle charge of above about −15 μC/g in an environment of about 28° C. and about 85% relative humidity.

16. A toner particle, comprising:

a core;

a shell surrounding the core; and charge enhanced spacer particles comprising a copolymer of a charge control agent and a monomer, wherein the charge enhanced spacer particles have a particle size from about 350 nm to about 500 nm, wherein the charge enhanced spacer particles are disposed on to the surface of the shell.

17. The toner of claim 16, wherein the charge control agent is selected from the group consisting of quarternary ammonium compounds, organic sulfate and sulfonate compounds, cetyl pyridinium tetrafluoroborates, distearyl dimethyl ammonium methyl sulfate, aluminum salts, zinc salts, and triarylamines.

18. The toner of claim 16, wherein the monomer is a functional monomer selected from the group consisting of acrylic acid, methacrylic acid, β-carboxylic acrylate, poly(2-carboxyethyl) acrylate, 2-carboxyethyl methacrylate, and combinations thereof.

19. The toner of claim 16, wherein the charge control agent is a zinc-type salicylic acid or an aluminum-type salicyclic acid, and the monomer is methyl methacrylate.

* * * * *